US007069959B2

(12) United States Patent
Manthey et al.

(10) Patent No.: US 7,069,959 B2
(45) Date of Patent: Jul. 4, 2006

(54) HEDDLE SHAFT ROD, METHOD FOR PRODUCING IT, AND HEDDLE SHAFT

(75) Inventors: Reiner Manthey, Raesfeld (DE); Rudolf Rossing, Borken (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 10/861,513

(22) Filed: Jun. 7, 2004

(65) Prior Publication Data

US 2005/0016612 A1 Jan. 27, 2005

(30) Foreign Application Priority Data

Jun. 6, 2003 (DE) ..... 103 26 123

(51) Int. Cl.
*D03C 9/06* (2006.01)

(52) U.S. Cl. ..... 139/91

(58) Field of Classification Search ..... 139/91, 139/92, 82, 55.1, 35
See application file for complete search history.

(56) References Cited

U.S. PATENT DOCUMENTS 4,484,604 A * 11/1984 Kramer et al. ..... 139/92
4,544,598 A * 10/1985 Meiller et al. ..... 442/223
4,633,916 A * 1/1987 Rast ..... 139/92
4,790,357 A * 12/1988 Kramer ..... 139/91
4,913,193 A * 4/1990 Faasse ..... 139/91
4,913,194 A * 4/1990 Kramer ..... 139/91
5,178,192 A * 1/1993 Koch ..... 139/91
5,230,370 A * 7/1993 Gysin ..... 139/92

FOREIGN PATENT DOCUMENTS

DE 39 37 657 A1 6/1990
DE 41 01 512 C1 2/1992
EP 457210 A1 * 11/1991

* cited by examiner

*Primary Examiner*—John J. Calvert
*Assistant Examiner*—Andrew W. Sutton
(74) *Attorney, Agent, or Firm*—Fitch, Even, Tabin, Tabin & Flannery; Norman N. Kunitz

(57) ABSTRACT

A heddle shaft is formed of a hollow metal profile section into which an expanding element for vibration damping is inserted. The expanding element is for example a precompressed foam strip which expands after insertion into the internal chamber of the hollow metal profile section until it is seated with a certain initial tension between the side walls of the hollow metal profile section. It is embodied as a solid (non-liquid) body and is introduced as such into the internal chamber. For being locked in place, it can be provided with adhesive faces.

15 Claims, 4 Drawing Sheets

HEDDLE SHAFT ROD, METHOD FOR PRODUCING IT, AND HEDDLE SHAFT

CROSS REFERENCE TO RELATED APPLICATIONS

This application claims the priority of German Patent Application No. 103 26 123.0, filed on Jun. 6, 2003, the subject matter of which, in its entirety, is incorporated herein by reference.

FIELD OF THE INVENTION

The invention relates to a heddle shaft rod and its production, to a heddle shaft having at least one such heddle shaft rod, and to a special foam strip suitable for producing such a heddle shaft rod.

BACKGROUND OF THE INVENTION

In power looms, heddle shafts are provided that are formed by a rectangular frame with heddles located in it. The heddle shaft has one or more heddle shaft rods, which are located transversely to the direction of motion of the heddle shaft and carry the heddle support rails for the heddles. The heddle shaft rods must be as lightweight and rigid as possible. To that end, it is known to make them from a lightweight hollow metal profile section. This is taught for instance by German Patent DE-PS 23 27 044.

There has long been a need to reduce the noise created by a power loom. The noise originates at least in part in the heddles, which are seated with some play on the heddle support rails. The reciprocating motion of the heddle shaft causes constant impacting or striking of the end eyelets of the heddles against corresponding stop faces of the heddle support rail. The noise thus engendered is considerable.

In response to this problem, the aforementioned German Patent DE-PS 23 27 044 proposes that the side walls, of the hollow metal profile section from which the heddle shaft is formed, be bulged inward somewhat, so that seen from outside, the side walls have a concave curvature. An inlay of acoustic damping material is then press-fitted into the hollow chamber enclosed by the side walls and presses the side walls outward, so that in the working position they extend parallel to one another. At least for relatively long heddle shaft rods, this provision is relatively difficult to execute. For that purpose the rails of acoustic damping material must be relatively rigid in the longitudinal direction, which in turn compromises their acoustic damping properties. This is all the more true when the acoustic damping element must be subject to a considerable clamping force, if it is to be capable of stressing side walls of the hollow metal profile section away from one another and thereby deforming them. It is thus hardly possible to produce long heddle shafts. It can furthermore prove difficult to adapt the lateral pressure precisely such that the previously concavely inward-curved side wall is actually straight in use, with the damping element inserted. If straightness is not attained, however, the bending strength of the hollow metal profile section is impaired, which can in turn cause difficulties.

It is also known from Japanese Patent Disclosure JP 61-159380 to fill a hollow chamber in a heddle shaft rod with a laminate, comprising a foam and rubberlike layers, for damping purposes; this laminate expands under the effect of heat. Equipping the hollow chamber of the heddle shaft rod with it and ensuing heating process are time-consuming and expensive. In addition, the heating process has the risk that the shape and structure of the heddle shaft rod will change.

All the known methods or constructions, if they involve introducing damping materials into the heddle shaft rod, have one or another disadvantage in terms of technology or manipulation.

With this as the point of departure, it is the object of the invention to create a heddle shaft rod which has an acoustic damping effect and is simple to produce and is furthermore unimpaired in its mechanical properties. It is also the object of the invention to furnish a method for producing such a heddle shaft rod and the utensils required for this.

SUMMARY OF THE INVENTION

The above object is attained with the heddle shaft rod according to the invention, as well as the novel method for making this heddle shaft rod, the expandable foam strip used in making the heddle shaft rod, and the novel use of the expandable foam strip.

The heddle shaft rod of the invention, in its internal chamber, has an expanding element which rests against the side walls with prestressing force. The expanding element has an inherent expansion capability. This means that when it is compressed, it initially maintains its compressed shape and then gradually, for instance over the course of several seconds, minutes, or even days, resumes its original thickness again. From the compressed state, the expanding element can swell up preferably without thermal influence and without other external influences, or in other words can do so for instance at room temperature. In this swelling or expansion process, it then conforms to the inner walls of the internal chamber of the metal profile body and gradually, over the course of its expansion process, builds up a wall of pressure. It thus stresses the side walls of the metal profile section body away from one another. The pressure thus exerted over the surface area prevents the side walls from being capable of vibrating freely when they are excited by impact, shock or other factors. This reduces the noise produced considerably.

On the other hand, such a heddle shaft rod is relatively simple to produce, because the previously compressed expanding element can be pushed freely into the metal profile section body in the compressed state and initially maintains its compressed shape. Thus it can be thrust like a rod into the internal chamber with great play, without requiring special aids for the purpose. Hence even very long heddle shaft rods can thus be provided with the acoustic damping expanding element. Furthermore, relatively long hollow metal profile section segments kept on hand can be provided with an expanding foam element, and then the desired lengths can be cut from the relatively long metal profile section as needed.

One special feature of the expanding element is its property of initially maintaining its compressed state when it is released, that is, unwound from a roll, for instance, and only then in the course of time gradually or with a time lag resuming its initial state again. In the freely expanded state, it preferably has a thickness DF which is greater than the spacing to be measured between the side walls of the metal profile section. As a result, by itself, it spans the internal chamber in the metal profile section. In the compressed state, however, it is markedly thinner than the clearance width of the internal chamber, making it very easy to manipulate.

The pressure that the expanding element exerts on the side walls is preferably so slight that no visible deformation of the side walls of the metal profile section occurs. The side walls are preferably essentially straight both before the expanding element is inserted and after the expanding element has expanded. Thus the buckling resistance of the expanding element, embodied for instance as a box profile section, is not impaired in any way.

The expanding element preferably comprises a foamed polyurethane plastic. It can be a sealing strip known per se, of the kind used to seal outer wall seams in the construction field. Compared to the expansion of hollow metal profile sections with amorphous plastic foams, such as two-component foam, introducing hardened, but viscoelastically deformable plastic foams, in the form of a manipulatable element, into the internal chamber of the hollow metal profile section has advantages in terms of manipulation, which are then expressed as cost advantages. Moreover, it is also thus achieved that the damping element has sufficient homogeneity, which cannot be assured readily upon the expansion of plastic foams that are introduced in liquid form. This applies particularly to homogeneity in the longitudinal direction. It is furthermore possible to provide intentional nonhomogeneities, for instance by providing that the prefabricated damping element has different pore sizes at the edge and in its core. Moreover, it is possible for the striplike damping element to be provided with recesses, such as holes, that penetrate it crosswise. The axes of these openings are for instance perpendicular to the side walls of the hollow metal profile section, once the damping element has been introduced into its internal chamber. It can then be embodied in ladder-like form, for instance, as a result of which a substantial saving in weight is attained, with at the same time good acoustic damping properties. As a result of the adhesive fixation of the fully expanded damping element in the internal chamber and the increased bending strength of the damping element in the compressed state, even relatively filigree-like damping elements with large recesses can be introduced into the hollow metal profile section in a securely manipulated way.

Especially good acoustic damping effects can be attained if the damping element (sealing strip) is adhesively bonded to the hollow metal profile section on at least one side, but preferably on both sides, that is, on both side walls. Firm bonding of the expanding foam element on both sides also assures good seating of the expanding foam element in the hollow profile section, even if it only partly fills up the hollow space.

The expanding foam element can be located, parallel to the longitudinal direction of the hollow metal profile section, in the internal chamber of this hollow metal profile section. It is preferably inserted approximately centrally into the chamber, so that it will damp the peak vibrations in the fundamental wave of the wall vibration as strongly as possible. It is furthermore possible to embody the expanding foam element such that it swells up not only transversely but also parallel to the side walls, so that it fills up the internal chamber to a greater extent or even entirely. It is furthermore possible to subdivide the expanding foam element into individual pieces and to locate it for instance only at certain places in the hollow metal profile section, selected on the basis of technical vibrational aspects. Furthermore, it is possible to shift it along a wave line, to prevent the development of standing waves at or on the metal profile section.

The side walls of the hollow metal profile section are preferably embodied continuously and with constant thickness in the longitudinal direction. However, it is also possible to insert the expanding foam element into hollow metal profile sections of varying wall thickness. In such hollow metal profile sections, the expanding foam elements are especially advantageous to use. They make it possible to develop a controlled wall pressure that prevents a deformation of parts of the side wall that are severely weakened for the sake of weight.

In the simplest case, a conventional precompressed expanding foam strip from the construction field can be employed. However, from the standpoint of manipulation, it is advantageous to provide the expanding foam strip, which has an adhesive layer on one or both sides, with a mask, for instance in the form of a perforated strip, or other kinds of spacer elements, which remain on the expanding strip and are incorporated into the hollow metal profile section after a protective backing has been peeled off. The advantage is that the mask prevents the adhesive layer from touching the side walls of the hollow metal profile section immediately and adhering to them, which would make it difficult to introduce the expanding foam. Instead, the expanding foam strip, partly covered by the mask, can be inserted freely into the hollow profile section. Once the expanding foam strip has expanded, the adhesive faces, through the recesses in the mask, touch the walls of the profile section and secure or lock the expanding foam strip in the desired position.

BRIEF DESCRIPTION OF THE DRAWINGS

Further details of advantageous embodiments of the invention will become apparent from the drawing, the description, and/or the dependent claims. In the drawing, exemplary embodiments of the invention are shown. Shown are:

DETAILED DESCRIPTION OF THE DRAWINGS

Figure 1:
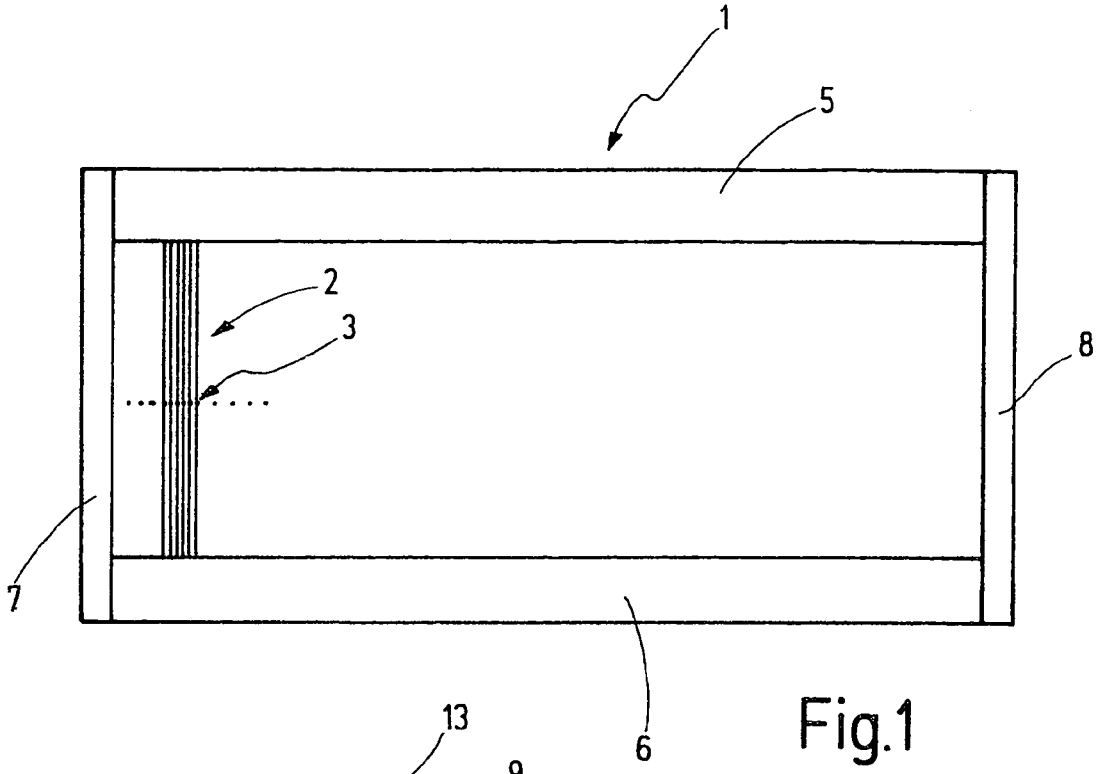
FIG. 1, a schematic elevation view of a heddle shaft.

In FIG. 1, a heddle shaft 1 is shown which is intended for forming sheds of the warp threads in a power loom. The warp threads are passed through heddles 2, or the yarn eyelets 3 thereof. With their end eyelets, the heddles 2 are suspended from heddle support rails 4 (shown for example in FIG. 2). The heddle support rails 4 are each retained by a respective heddle shaft rod 5, 6, which together with lateral struts 7, 8 form the framelike heddle shaft 1.

Figure 2:
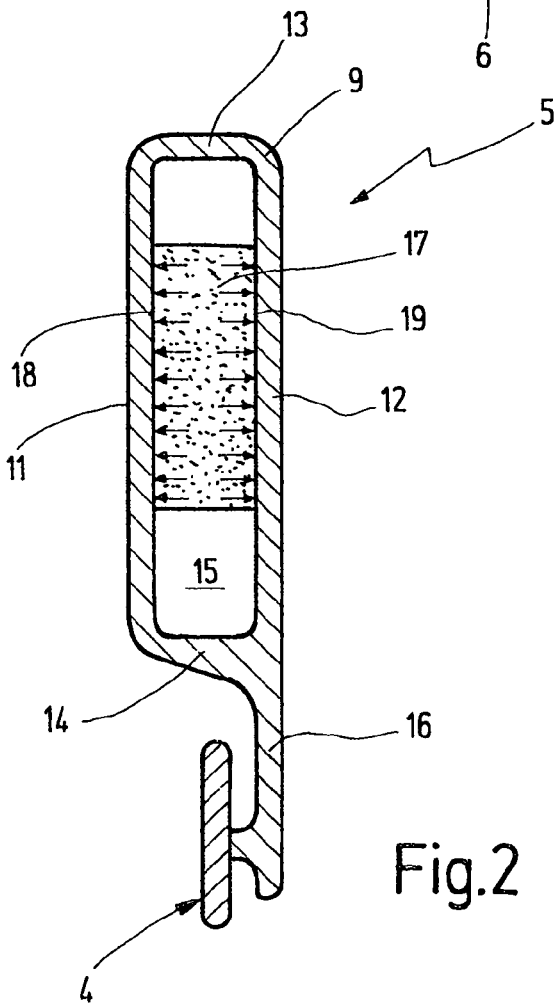
FIG. 2, a schematic cross section through a heddle shaft rod of the heddle shaft of FIG. 1.

The heddle shaft rods 5, 6 are embodied identically or similarly to one another. FIG. 2 shows the heddle shaft rod 5 as an example. The description of it applies accordingly to the heddle shaft rod 6.

The heddle shaft rod 5 is formed by a hollow metal profile section 9, for example an extruded aluminum profile section, which has two flat, preferably smooth side walls 11, 12, which are spaced apart from and parallel to one another. Together, with a narrow upper closure wall 13 and a lower closure wall 14, they surround an internal chamber 15, for instance of rectangular cross section. The cross section of the internal chamber 15 is preferably unchanged in the longitudinal direction, which in FIG. 2 is perpendicular to the plane of the drawing. The internal chamber 15 may, as shown in FIG. 2, be entirely closed. It is also possible to provide a partly open internal chamber 15, for instance by providing that one of the side walls 11, 12 has slots or that the closure wall 13 or 14 is missing entirely or in part.

Adjoining the lower closure wall 14, in a straight extension of the side wall 12, is a support strut 16, which carries the heddle support rail 4.

An expanding element 17 is located in the internal chamber 15 and is seated with some prestressing, or initial tension, between the side walls 11, 12. The expanding element 17 is preferably a strip of viscoelastic foam, such as polyurethane foam, soft polyurethane foam with modified acrylates, or some other plastic. The foam can have open or closed pores. An open-pore foam is preferred for the sake of its good acoustic damping and its good elasticity. Compressible viscoelastic bodies of some other porosity can also be used as the expanding element 17, examples being fiber bodies, felts, knitted articles, woven articles, or the like. What is essential is only that this body have a low density, preferably <1 g/cm$^3$, good damping action, for instance as a consequence of internal friction, and slow, viscoelastic expansion behavior. The restorability of the expanding element 17 should be dimensioned such that after compression in the transverse direction, it remains in the compressed position for a time sufficient for manipulation and then gradually expands, or in other words attempts to resume its original shape. The expanding element 17 is shown in this expanded state in FIG. 2. It has a rectangular cross section with two flat sides, on which adhesive layers 18, 19 are provided. These layers are created by a coating of an adhesive material which offers good adherence to the metal, such as aluminum, that forms the material of the side walls 11, 12.

The expanding element 17 is located approximately centrally in the internal chamber 15, with spacings or free spaces remaining toward the closure walls 13, 14. If needed, however, the expanding element 17 can also be made so large that at least in the expanded state, it completely fills up the internal chamber 15.

The adhesive layers 18, 19 can adhere directly and over the full surface to side walls 11, 12. However, embodiments are also possible in which only one flat side of the expanding element 17 is provided with an adhesive layer, while the other side then rests on the respective side wall solely by initial tension.

Figure 3:
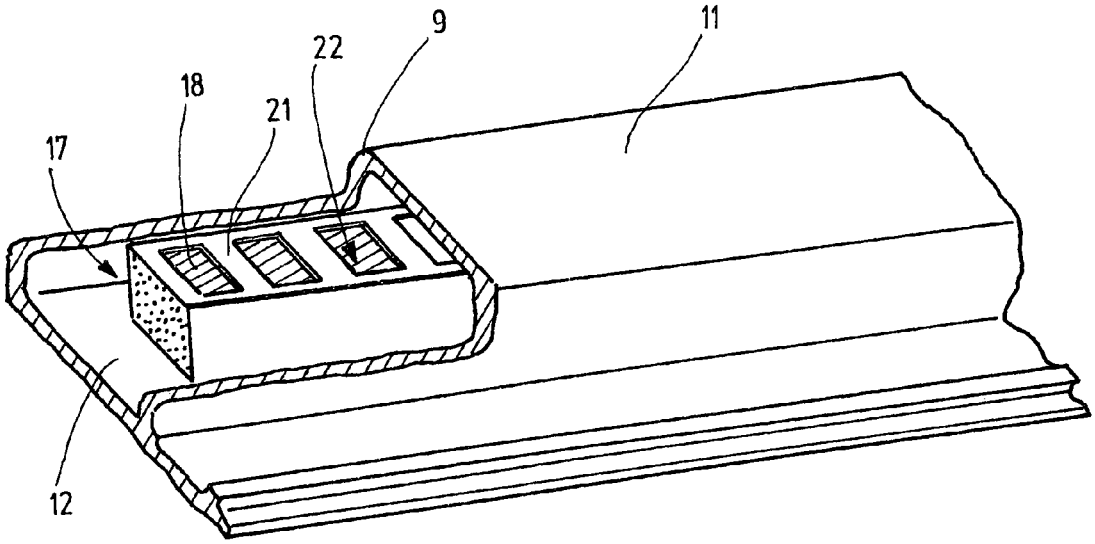
FIG. 3, a perspective view, partly in section, of the heddle shaft rod of FIG. 2.

An embodiment in which the adhesive layers 18, 19 are provided with masks is also considered advantageous. The mask 21 adhering to the adhesive layer 18 can be seen in FIG. 3. The mask is formed for instance by a not overly thin plastic film, metal foil, or similar element that adheres to the adhesive layer 18 and covers some parts of the adhesive layer 18 and in turn leaves other parts of the adhesive layer 18 exposed. To that end, the mask 21 is provided with openings or windows 22. Preferably, these openings or windows leave the adhesive layer 18 for the most part exposed and only cover a slight portion of it. Instead of the embodiment with a ladder-shaped mask shown in FIG. 3, it is possible for one, two or more striplike elements to extend in the longitudinal direction on the adhesive layer 18, with parts of the adhesive layer 18 located between them remaining free.

Figure 4:
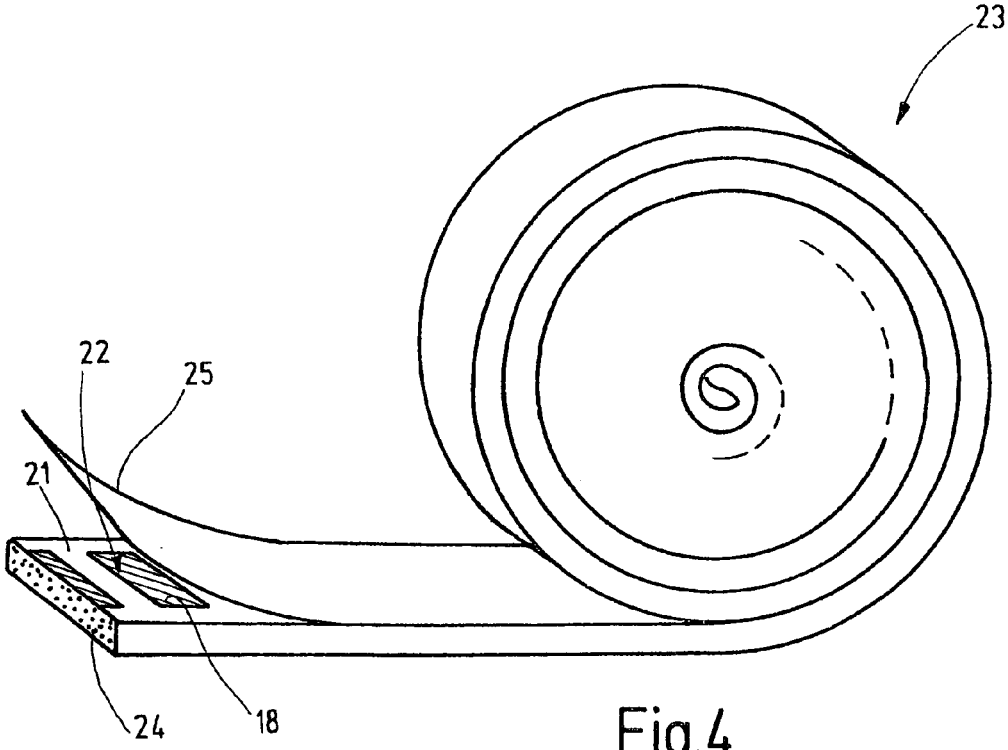
FIG. 4, a perspective view of a compressed expanding foam strip for introduction into the heddle shaft rod.

The expanding element 17 can be cut to length from endless material furnished in a roll 23. FIG. 4 shows such a roll, with a modified sealing strip. The sealing strip comprises a precompressed foam body 24 that forms the later expanding element 17. The mask 21 is located under a protective backing 25. The protective backing 25 adheres to the adhesive layer 18 that is accessible through the windows 22. The thickness of the mask 21 is dimensioned such and adapted in such a way to the expansion speed of the foam body 24 that after the protective backing 25 has been removed, only little foam, if any, initially bulges out through the windows 22.

Figure 5:
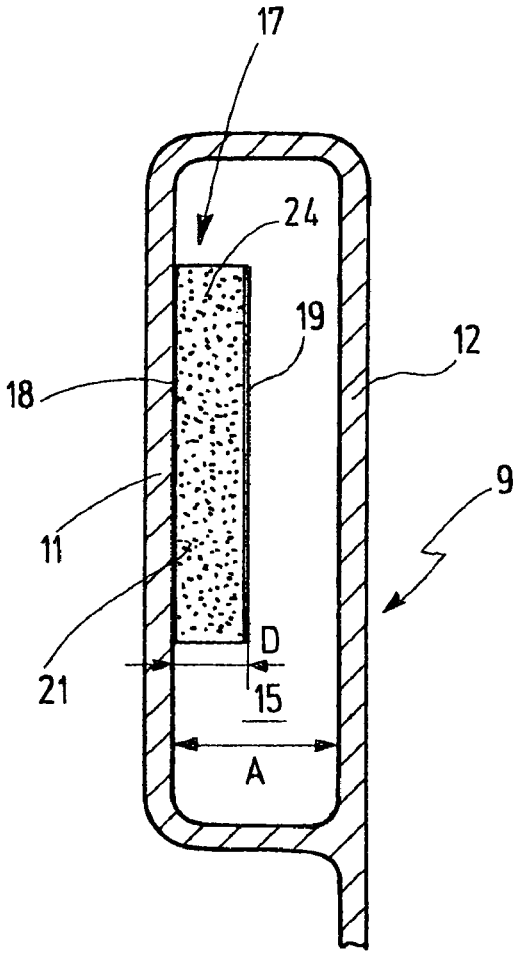
FIG. 5, a cross section through the heddle shaft rod after the introduction of a compressed expanding foam strip.
Figure 6:
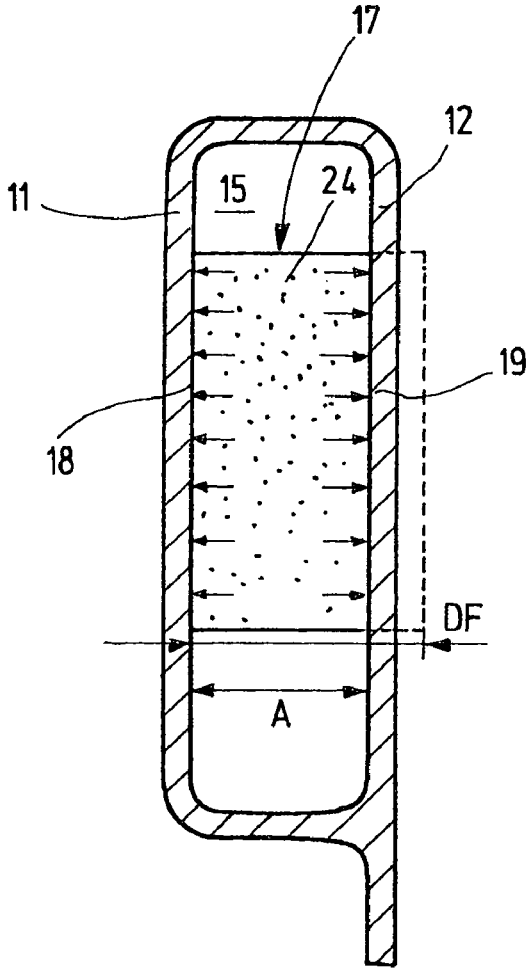
FIG. 6, a cross section through the heddle shaft rod of FIG. 5 after the expansion of the expanding foam strip.

The expanding element 17 is installed in the hollow metal profile section 9 as follows:

As FIGS. 5 and 6 show, the compressed sealing strip, freed of its protective backing 25 and cut to the appropriate length, is introduced into the internal chamber 15 and presses against the side wall 11 (or also against the opposite side wall 12). The compressed sealing strip is compacted and therefore has relatively good buckling strength and can be inserted like a rod. The mask 21 present on the adhesive layer 18 prevents the adhesive layer 18 from adhering to the side wall 11 immediately upon being inserted and thus hindering the insertion process. Once the expanding element 17 has been inserted, the hollow metal profile section 9 should initially rest for a certain dwell time, which is adapted to the expansion speed of the expanding element 17, so that the expanding element 17 as it swells up can become firmly seated. The foam body 24 can now gradually swell up. In this sense, it has a memory function. Its compressed thickness D, which is markedly less than the spacing A of the side walls 11, 12 from one another, gradually increases, until its adhesive layer 19 touches the inside of the side wall 19. As the expansion of the foam body 24 progresses, the adhesive layer 19 then presses against the side wall 12, and the adhesive layer 18 also presses against the side wall 11. Thus a firmly adhering bond is created at both side walls 11, 12, and an outward-oriented compressive force is exerted against the side walls 11, 12 by the expanding element 17, as FIG. 6 shows. This is achieved by providing that the expanding element 17 is dimensioned such that its freely expanded thickness DF, which is represented in FIG. 6 by a dashed-line contour, is markedly greater than the spacing A. The height (measured parallel to the side walls 11, 12) of the expanding element 17, or its spring constant, however, is dimensioned such that no significant deformation of the side walls 11, 12 occurs.

To facilitate the insertion process, the adhesive layer 19 can also be provided with a mask. This can be embodied like the mask 21.

In principle, the mask 21 and the protective backing 25 may have dimensions which deviate from the dimensions of the expanding element.

It is also possible to introduce the sealing strip along with the protective backing 25 into the internal chamber 15 and then to peel off the protective backing 25 through the internal chamber 15.

Figure 7:
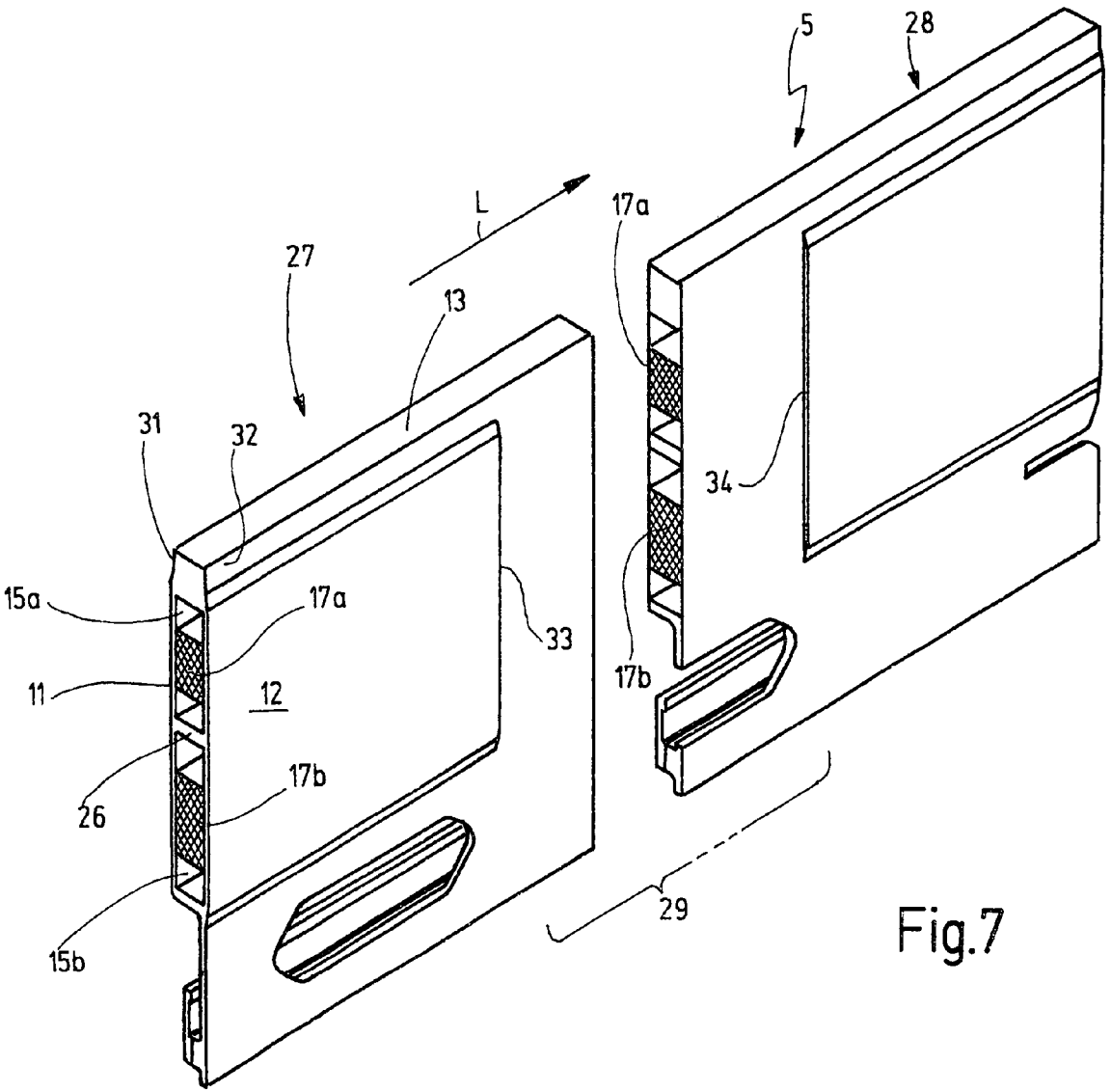
FIG. 7, a perspective view, partly in section and shortened, of a modified embodiment of a heddle shaft rod.

FIG. 7 illustrates a modified embodiment of a heddle shaft rod, which, however, because it fundamentally agrees with the heddle shaft rod described above is also identified by reference numeral 5. Unless differences are pointed out below, the above description applies accordingly.

The heddle shaft rod 5 of FIG. 7 has a multi-chamber hollow profile section. Its internal chamber 5 is subdivided, by a cross member 26 that joins the side walls 11, 12 to one another, into two partial chambers 15*a*, 15*b*. Into both of them, by the method described above, expanding elements 17*a*, 17*b* are inserted. These can have either identical dimensions or different dimensions.

A further special feature of the heddle shaft rod 5 of FIG. 7 is the embodiment of the side walls 11, 12. These have varying thicknesses in the longitudinal direction L of the heddle shaft rod 5. While particularly at the ends 27, 28 of the heddle shaft rod 5 the side walls 11, 12 are unweakened, in a middle region 29 they are substantially thinner or in other words weakened. This can be accomplished by metal-cutting removal of the outward-protruding portions of the side walls 11, 12 that are present at the ends 27, 28. Preferably, the side walls 11, 12 are offset outward so far, or so little, that the upper closure wall 13 laterally defining faces 31, 32, extending in the longitudinal direction and each located in a plane that is located inside the respective side wall 11, 12. Flat milling of the side faces adjoining the faces 31, 32 in the middle region 29 thus leads to a reduction in the thickness of the side walls 11, 12 in this middle region 29, without creating breaches there. The result is steplike transitions 33, 34, at which the wall thickness changes. The expanding elements 17*a*, 17*b* extend over the full length of the heddle shaft rod 5, or at least over its middle region 29, in order not to damp the existing thin side wall regions but instead simultaneously to reinforce them. A relatively slight wall pressure can be employed here, if the thickness DF is only slightly greater than the width A. However, particularly here, the expanding element 17 (17*a*, 17*b*) contributes to reducing vibration, which not only has the effect of reducing noise but also counteracts the tendencies of the side walls 11, 12 to buckle and thus increases the dynamic load-bearing capacity of the hollow metal profile section 9.

A heddle shaft 1 is formed of a hollow metal profile section 9 into which an expanding element 17 for vibration damping is inserted. The expanding element 17 is for example a precompressed foam strip which expands after insertion into the internal chamber 15 of the hollow metal profile section 9 until it is seated with a certain initial tension between the side walls 11, 12 of the hollow metal profile section 9. It is embodied as a solid (non-liquid) body and is introduced as such into the internal chamber 15. For being locked in place, it can be provided with adhesive faces 18, 19.

| List of Reference Numerals: | |
|---|---|
| 1 | Heddle shaft |
| 2 | Heddle |
| 3 | Yarn eyelet |
| 4 | Heddle support rails |
| 5, 6 | Heddle shaft rod |
| 7, 8 | Lateral strut |
| 9 | Hollow metal profile section |
| 11, 12 | Side walls |
| 13, 14 | closure wall |
| 15 | Internal chamber |
| 15a, 15b | Partial chambers |
| 16 | Support strut |
| 17 | Expanding element |
| 18, 19 | Adhesive layers |
| 21 | Mask |
| 22 | Window |
| 23 | Roll |
| 24 | Foam body |
| 25 | Protective backing |
| 26 | Cross member |
| 27, 28 | Ends |
| 29 | Middle region |
| 31, 32 | Faces |
| 33, 34 | Transitions |

-continued

| List of Reference Numerals: | |
|---|---|
| DF | Expanded foam thickness |
| D | Compressed thickness |
| A | Spacing of side walls |

The invention claimed is:

1. A heddle shaft rod for heddle shafts of power looms, comprising an elongated hollow metal profile section, which has two side walls between which at least one internal chamber is embodied, an expanding element which is located in the internal chamber and which rests with initial prestressing against the side walls; and wherein the expanding element, in an original previously compressed state, has a thickness (D) which is less than the spacing A between the side walls.

2. The heddle shaft rod of claim 1, wherein the expanding element has an inherent cold expansion capability when compressed.

3. The heddle shaft rod of claim 1, wherein the two side walls are oriented parallel to one another.

4. The heddle shaft rod of claim 1, wherein the expanding element, in the freely expanded state, has a thickness (DF) which is greater than the spacing (A) between the side walls.

5. The heddle shaft rod of claim 1, wherein the expanding element comprises a foamed polyurethane plastic.

6. The heddle shaft rod of claim 1, wherein the expanding element has a rectangular cross section.

7. The heddle shaft rod of claim 6, wherein the expanding element fills up the internal chamber only partially.

8. The heddle shaft rod of claim 1, wherein the expanding element is embodied as viscoelastic.

9. The heddle shaft rod of claim 8, wherein the expanding element is joined by material to material engagement to at least one of the side walls.

10. The heddle shaft rod of claim 1, wherein the expanding element is joined by material to material engagement to both side walls.

11. The heddle shaft rod of claim 10, wherein a mask is located between the expanding element and the side wall.

12. The heddle shaft rod of claim 11, wherein the mask is a perforated mask or a slotted mask.

13. A heddle shaft for a power loom, having at least one heddle shaft rod of according to claim 1.

14. A heddle shaft rod for heddle shafts of power looms, comprising:

an elongated hollow metal profile section, which has two side walls between which at least one internal chamber is formed;

an expanding element, which is located in the internal chamber and which rests with prestressing against the side walls, and is joined by material to material engagement to both side walls; and, a mask is located between the expanding element and the side wall.

15. The heddle shaft rod of claim 14, wherein the mask is a perforated mask or a slotted mask.

* * * * *